United States Patent [19]

Skipper

[11] 4,394,884

[45] Jul. 26, 1983

[54] SHOCK SUB

[76] Inventor: Uvon Skipper, 11710 Scottsdale Rd., Stafford, Tex. 77477

[21] Appl. No.: 172,662

[22] Filed: Jul. 28, 1980

[51] Int. Cl.[3] ..... E21B 17/20

[52] U.S. Cl. ..... 175/321; 267/125

[58] Field of Search ..... 175/321, 65, 27, 38; 64/23; 267/125

[56] References Cited

U.S. PATENT DOCUMENTS

| | | | |
|---|---|---|---|
| 3,382,936 | 5/1968 | Galle | 175/321 |
| 3,947,008 | 3/1971 | Mullins | 267/125 |
| 3,963,228 | 6/1976 | Karle | 267/125 |
| 4,051,696 | 10/1977 | Mason et al. | 64/23 |
| 4,055,338 | 10/1977 | Dyer | 175/321 |
| 4,257,245 | 3/1981 | Toelke et al. | 64/23 |

*Primary Examiner*—William F. Pate, III

*Attorney, Agent, or Firm*—Gunn, Lee & Jackson

[57] ABSTRACT

For use in a string of drill pipe terminating in drill collars and a drill bit, a shock sub is disclosed which, in the illustrated and preferred embodiment, incorporates telescoping upper and lower mandrels. The upper mandrel incorporates a pin connection and supports concentrically deployed, inner and outer tubular sleeves defining an internal cavity. The lower mandrel incorporates an upstanding sleeve which telescopes into the cavity between the sleeves of the upper mandrel. A two-chamber fluid damping system constrains movement of the lower mandrel sliding in the cavity of the upper mandrel. The two chambers are defined by meshed splines which permit telescoping movement, but which prevent relative rotational movement.

12 Claims, 4 Drawing Figures

SHOCK SUB

BACKGROUND OF THE DISCLOSURE

This disclosure is directed to a shock sub to be installed in a drill string. In drilling an oil well, the drill string is assembled from the requisite number of drill pipe attached to a series of heavy wall drill pipe often called drill collars and terminates at a drill bit. The drill bit rides on the bottom of the hole, and, during rotation, it chatters as it bites into the formation being drilled. This continual chatter has the form of shock impacted vertical motion, thereby imparting vibration to the entire drill string. Since the drill string is formed of metal pipe without cushioning at the joints, the vibration is coupled through the entire drill string. The vibration is a source of wear and tear, particularly at the tool joints and drill bit where the various tubular members are threaded together.

It is difficult to eliminate all vibration because the drill string, itself, provides a significant weight on the drill bit which is important to drill bit operation. It is essential that a significant weight be placed on the drill bit, and, to this end, it is not desirable to totally cushion movement of the drill bit. The present invention is an apparatus which provides a significant load on the drill bit so that drill bit operation continues in the desired manner and rate, and yet, the present apparatus additionally dampens the chatter or high frequency vibrations of the drill string. This is accomplished in an apparatus which is, in retrospect, relatively simple in construction. The apparatus incorporates a hydraulic damping system which includes an internal cavity filled with a compressible fluid which is the primary shock absorbing feature. The hydrostatic pressure tends to compress the fluid. The shock sub, however, remains elongated and does not bottom out. Elongation is helped by converting the pressure of the mud flow through the shock sub into a force impinging on a set of shoulders which tends to elongate the tool. This helps to overcome some of the reaction of the tool due to hydrostatic pressure or the weight of the drill string which tends to compress the tool and thereby helps to achieve continued operation at an intermediate point over a greater range of drilling weights and hydrostatic pressure. The intermediate point permits travel in both directions during operation.

The apparatus of this disclosure includes these features and several other features of importance wherein the shock sub is formed with pin and box connections affixed at the ends of upper and lower telescoping mandrels. The upper mandrel is formed of concentrically arranged inner and outer sleeves. They define an internal cavity which receives an upstanding sleeve from the lower mandrel. The upstanding sleeve is positioned in the axial cavity and telescopes in movement. Suitable seals prevent leakage along the telescoped upstanding sleeve. Moreover, a set of meshed splines on both mandrels permits telescoping movement while preventing relative rotation between the mandrels. The meshed splines may be cut on a helix either in the direction of rotation or against it to help to convert the torsional load to an axial load to better utilize the shock absorbing effect of the liquid spring. The sensitivity of the tool may be changed by changing the volume of fluid in the internal cavity; therefore, these changes can be accomplished by adding or deleting volume rings of a solid substance as shown in the drawing.

BRIEF DESCRIPTION OF THE DRAWINGS

So that the manner in which the above recited features, advantages and objects of the invention, as well as others which will become apparent, are attained and can be understood in detail, a more particular description of the invention briefly summarized above may be had by reference to the embodiments thereof illustrated in the appended drawings, which drawings form a part of this specification. It is to be noted, however, that the appended drawings illustrate only typical embodiments of the invention and are not to be considered limiting of its scope, for the invention may admit to other equally effective embodiments.

DETAILED DESCRIPTION OF THE PREFERRED EMBODIMENT

Figure 1A:
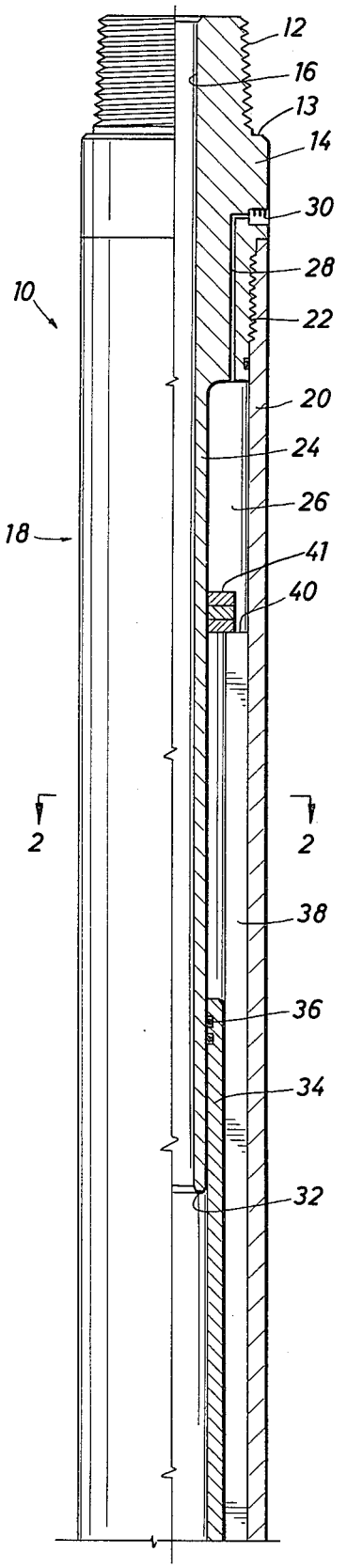
FIG. 1, which is formed of segments 1A and 1B, is a lengthwise view, partly in section, of the shock sub of the present disclosure showing details of construction of the upper and lower telescoped mandrels.
Figure 1B:
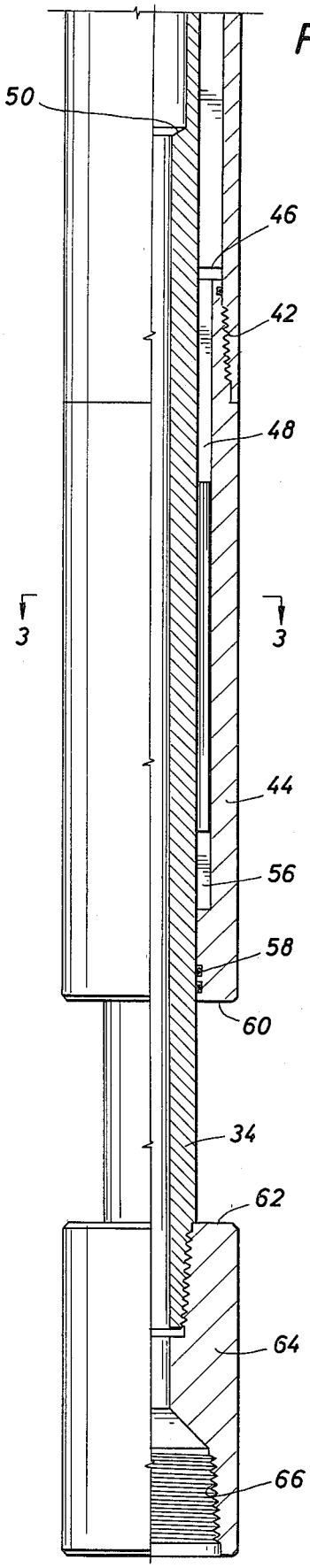

Attention is first directed to FIG. 1 of the drawings where the numeral 10 identifies the shock sub of the present disclosure. The description of the shock sub will proceed from the upper end to the lower end. The upper end incorporates a pin connector 12 which joins to a drill string utilizing threaded connections conforming with industry standards. The pin connector 12 terminates at a shoulder 13 which defines an upper fitting 14 of substantial thickness, indeed, having a diameter preferably equal to the drill collars which are placed in the drill string thereabove. An axial passage 16 is formed in the upper mandrel generally identified by the numeral 18. An external tubular sleeve 20 is joined to the fitting at a threaded connection 22. The threaded connection 22 enables the outer tubular sleeve to be separately fabricated and installed, thereby permitting access to the upper mandrel. The upper mandrel further incorporates an inner tubular sleeve 24 which is concentric of the outer tubular sleeve. It will be observed that the two sleeves define an annular cavity which incorporates an upper chamber 26 and which receives other apparatus therein to define a lower chamber as will be identified herebelow. The upper chamber 26 is a fluid receiving chamber, and fluid is placed therein through the utilization of a fill passage 28 selectively closed by a threaded plug 30.

The inner sleeve 24 terminates at a shoulder 32 which is exposed to the passage 16 and, therefore, exposed to the pressure of the mud flowing through the upper mandrel. The chamber 26 is on the exterior of the inner sleeve 24 and is deployed at the upper end just below the fitting 14. This enables isolation of the chamber 26. A seal is perfected with this chamber to prevent leakage. The seal utilizes the outer surface of the tubular sleeve 24. The lower mandrel includes an upstanding, telescoped tubular sleeve 34 which fits snugly about the inner sleeve 24, and suitable seal rings are placed in the grooves 36 for sealing. The seal rings in the grooves 36 seal against the inner sleeve and prevent leakage from the chamber 26 as will be understood hereinbelow.

Figure 2:
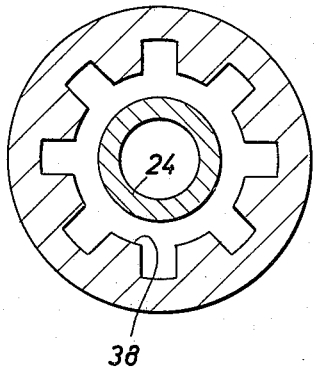
FIG. 2 is a sectional view through the shock sub along the line 2—2 of FIG. 1 disclosing internal details of construction.

The upstanding sleeve 34 slides over the sleeve 24. The range of travel permitted does not allow the two sleeves to pull apart. After assembly, they maintain the telescoped relationship shown in the drawings. The upstanding sleeve 34 is aligned for telescoping movement around the sleeve 24 by means of alignment splines 38. The splines 38 are formed on the interior of the outer sleeve 20. It is not essential that they extend into the chamber 26, and, accordingly, the splines 38 terminate at the shoulder 40 supporting volume rings 41 to vary capacity to the chamber 26. The splines extend radially inwardly sufficient to align the telescoped, upstanding sleeve 34. The several splines 38 are shown in FIG. 2 where the inner sleeve 24 is spaced from the splines by a distance sufficient to enable the upstanding sleeve 34 to easily traverse the annular space. The splines 38 accordingly provide a vertical flow path in the cavity between sleeves extending upwardly to the fluid chamber 26. The splines reduce the total or aggregate capacity, but they do not otherwise alter operation of the fluid chamber 26.

Figure 3:
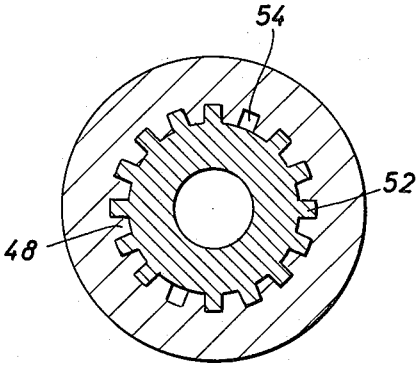
FIG. 3 is a sectional view along the line 3—3 of FIG. 1 showing a telescoping spline arrangement between the upper and lower mandrels.

The outer sleeve 20 is relatively long. Accordingly, the thread 22 defines the upper end of the first portion thereof, and this component extends downwardly to a threaded connection 42 better shown in FIG. 1B. There, the outer sleeve is continued with a lower sleeve extension 44. The splines 38 terminate at the shoulder 46 shown in FIG. 1B. Moreover, the lower sleeve extension 44 is sealed against the lower tubular sleeve 34. The lower sleeve extension 44 incorporates a set of internal splines 48 better shown in FIG. 3 of the drawings. The internal splines 48 extend radially inwardly toward the upstanding sleeve 34. The sleeve 34 is constructed with a relatively uniform exterior diameter along its full length. The wall thickness is increased at a shoulder 50 shown in FIG. 1B. The shoulder 50 faces the shoulder 32 on the inner sleeve 24.

The internal space within the sleeve 44 is thus defined by the splines 48 which comprise a first set of splines. They mesh with a set of splines 52 formed on the exterior of the inner sleeve, the sets of splines being better shown in FIG. 3 whereby telescoping movement is permitted, but relative rotation is forbidden. In particular, the splines 52 formed on the tubular sleeve 34 mesh with the vertical slots provided for their operation, except that one or two of the splines are omitted as better shown at 54. Omission of some splines allows a flow path past the meshed sets of splines so that the fluid does not retard the inter-movement of the splines. This flow path communicates the upper fluid chamber 26 with a lower fluid chamber 56 shown in FIG. 1B. The chamber 56 is below the meshed sets of splines. To this end, the splines 48 are relatively long compared to the splines 52 or vice versa. This enables continued telescoping movement without disengagement. Moreover, it enables the chamber 56 to receive a specified fluid volume. The chambers 26 and 56 are in fluid communication through the meshed sets of splines.

The lower sleeve extension 44 terminates at a shoulder 60 which faces an opposed shoulder 62. A seal 58 is just above the shoulder. The two shoulders are permitted to close against one another. When they close, an abutting relationship is achieved, thereby limiting telescoping movement of the tool. Ideally, the shoulders 60 and 62 are heavy duty shoulders and thereby able to withstand the violent slamming, shutting motion of the tool when it is telescoped to its minimum length. However, under normal operation, the shoulders 60 and 62 do not contact. This allows the full weight of the drill string to be carried on the tool without appreciable damage. The shoulders 60 and 62 preferably close before contact of the smaller shoulders 32 and 50 on the interior of the tool. The shoulders 60 and 62 thus provide heavy duty load bearing ability. The shoulder 62 is formed on a lower fitting 64 which is full gauge diameter preferably matching that of the drill collars. The fitting 64 is threaded to the upstanding sleeve 34, and the axial passage shown in the upper part of the tool extends through the fitting 64 and the threaded box connection 66. The fitting 64 is constructed to full gauge diameter to enclose the box connection shown therebelow. In the ordinary circumstance, the box connection 66 enables the shock sub to be connected directly to a drill bit. This then locates the shock sub in the preferred location immediately above the drill bit and below the drill collars and drill pipe in the drill string.

OPERATION OF THE PREFERRED EMBODIMENT

Operation of the device is achieved in the following manner. The tool is held in the full open position whereby the shoulders 60 and 62 are separated by the maximum distance. A compressible fluid is placed in the chamber 56 and fills the annular cavity to the chamber 26 through the use of the fill passage 28. The additional bleed passage, best located on the opposite end of the tool, allows circulation of the fluid to purge the system of air. The tool is preferably filled in an upright position to enable bubbles to escape so that no air is captured in the system. After the fluid has been placed in the system, the plug 30 is restored to close off the fluid system. It will be observed that the fluid system is fully isolated. Leakage to the exterior is prevented by the seals 58. Leakage from the fluid system into the mud flow passage is prevented by the seals 36.

During use, vibrations are imparted to the shock sub 10 from the drill bit. This takes the form of vibratory movement of the upstanding sleeve. Such movement is constrained to upward movement only by operation of the meshed splines shown in FIG. 3. The shock sub is at this juncture aptly installed in the drill string and continues to impart rotation to the drill bit because the spline arrangement shown in FIG. 3 prevents relative rotation between the upper and lower mandrels. The fluid chambers 26 and 56 are communicated. As telescoping movement occurs, the chambers change in relative volume or capacity. As this change occurs, some fluid inevitably must be transferred from one chamber to the other. The flow path is through the passage 54 past the meshed splines. The damping action is achieved by the compression of the fluid due to application of weight to the bit. It is the utilization of this liquid spring that supplies the primary shock absorbing effect. The rate at which the two mandrels telescope under the impetus of a shock depends in part on the dynamics of the fluid, the relative cross sectional area of the flow path at its narrowest passage and the total volume of fluid in the system.

The precise nature of the damping fluid used is subject to variation. Preferably, it is relatively insensitive to heat, maintains a relatively constant viscosity at elevated temperatures and is not subject to easy evaporation.

The spline is illustrated with straight ribs. They may be formed on a helix of either hand, thereby converting rotation into an axial bias force having a direction dependent on the direction and angle of the helix.

While the foregoing is directed to the preferred embodiment of the present invention, other and further embodiments of the invention may be devised without departing from the basic concept thereof, and the scope thereof is determined by the claims which follow.

I claim:

1. A shock absorbing tool to be installed in a drill string above the drill bit, comprising:

(a) an upper mandrel which includes (1) an upper end threaded connector for connection into a drill string;

(2) an outer tubular sleeve below said threaded connector and having a lower end seal around the interior thereof;

(3) an inner tubular sleeve concentric within said outer tubular sleeve;

(4) an annular cavity defined between said inner and outer tubular sleeves;

(5) means for closing said annular cavity at the upper end;

(6) alignment spline means extending axially into said annular cavity, said alignment spline means supported interiorally of said outer tubular sleeve and further being located above said lower end seal;

(b) a lower mandrel which includes (1) a lower end threaded connector for connection to a drill bit at the bottom of a drill string;

(2) an upstanding tubular sleeve;

(3) a bottom fitting joined to said connector and to said upstanding sleeve and further including an upwardly facing shoulder adapted to abut the lower end of said outer tubular sleeve to limit axial displacement of said outer tubular sleeve relative to said bottom fitting shoulder;

(4) a first set of splines on said upstanding sleeve meshing with a second set of splines for longitudinal displacement therebetween wherein said first and second sets of splines prevent relative rotation and permit relative axial displacement;

(5) wherein said first and second sets of splines are located for meshing above said lower end seal to define a lower fluid chamber above said lower end seal;

(6) wherein said lower end seal forms a leakproof seal against the exterior surface of said upstanding sleeve;

(7) wherein said upstanding sleeve extends above said meshed first and second sets of splines into said annular cavity to define an upper fluid chamber therein;

(8) seal means on said upstanding sleeve sealing against said upper mandrel to limit leakage from said upper fluid chamber on telescoping movement of said upstanding sleeve in said annular cavity;

(c) means for introducing a charge of compressable fluid into said annular cavity;

(d) wherein said first and second sets of splines telescope relative to one another, and said splines are constructed with a specific clearance to define a lengthwise flow path along said meshed splines between said upper and lower fluid chambers;

(e) a lengthwise axial passage for flowing drilling mud through said shock absorbing tool wherein said passage extends along the interior of said inner tubular sleeve and also serially through said upstanding sleeve and said fitting therebelow wherein said upstanding and inner sleeves telescope relative to one another and further wherein said sleeves include shoulder means exposed to mud flow along said passage;

(f) shoulder means, on exposure to drilling mud under pressure, are located and arranged to form a mud pressure depending force forcing said upper mandrel and lower mandrel apart and wherein the weight on the drill string forces said upper and lower mandrels towards each other; and (g) wherein said upper and lower mandrels move relatively as fluid is transferred between said upper and lower fluid chambers along the flow path of said meshed splines.

2. The apparatus of claim 1 wherein said meshed first and second sets of splines incorporate missing spline teeth to define a flow path between said upper and lower fluid chambers.

3. The apparatus of claim 1 including a fill passage opening into said internal cavity at one of said fluid chambers and including means for plugging said passage to enable selective charging of fluid into said chambers through said passage.

4. The apparatus of claim 3 wherein said fill passage is at the top of said upper chamber.

5. The apparatus of claim 1 wherein said shoulder means includes a first shoulder on said inner sleeve exposed to the pressure of mud flowing through said upper mandrel and further includes a facing second shoulder exposed to pressure of mud flowing through said lower mandrel wherein said second shoulder is supported on said upstanding sleeve.

6. The apparatus of claim 5 wherein said shoulders face one another and define relative cross-sectional areas responding to the pressure of mud flowing against said shoulders to create a force which forces said upper and lower mandrels apart.

7. The apparatus of claim 1 including alignment splines in said cavity aligning said upstanding sleeve for telescoping movement relative to said upper mandrel.

8. The apparatus of claim 7 wherein said alignment splines extend radially inwardly for aligning said upstanding sleeve.

9. The apparatus of claim 8 wherein said alignment splines terminate below said upper fluid chamber.

10. The apparatus of claim 1 wherein said outer sleeve supports seal means cooperating with said upstanding sleeve.

11. The apparatus of claim 1 wherein said splines extend helically on said tubular sleeves for converting torsional shock to a lateral load.

12. A shock absorbing tool to be installed in a drill string above the drill bit, comprising:

(a) an upper mandrel which includes (1) an upper end threaded connector for connection into a drill string;

(2) an annular cavity within said upper mandrel;

(3) means for closing said annular cavity at the upper end;

(4) a first set of splines extending downwardly adjacent to the lower portions of said annular cavity;

(b) a lower mandrel which includes (1) a lower end threaded connector for connection to a drill bit at the bottom of a drill string;

(2) an upstanding tubular sleeve;

(3) a bottom fitting joined to said connector and to said upstanding sleeve and further including an upwardly facing shoulder adapted to limit axial displacement of said upper mandrel relative to said bottom fitting shoulder;

(4) a second set of splines on said upstanding sleeve meshing with said first splines for longitudinal displacement therebetween wherein said first and second sets of splines prevent relative rotation and permit relative axial displacement;

(5) wherein said upstanding sleeve extends into said annular cavity to define an upper fluid chamber therein;

(6) seal means between said upstanding sleeve and said upper mandrel to limit fluid flow from said upper fluid chamber on telescoping movement of said upstanding sleeve in said cavity;

(7) a lower fluid chamber in said lower mandrel;

(c) means for introducing a charge of compressable fluid into said cavity;

(d) means defining a lengthwise flow path between said upper and lower fluid chambers;

(e) a lengthwise axial passage for flowing drilling mud through said shock absorbing tool wherein said passage extends along said upper and lower mandrels and said fitting therebelow wherein said mandrels telescope relative to one another;

(f) shoulder means on each of said mandrels exposed to mud flow along said passage wherein said shoulder means, on exposure to drilling mud under pressure, are located and arranged to form a mud pressure dependent force forcing said upper mandrel and lower mandrel apart and wherein the weight on the dill string forces said upper and lower mandrels towards each other; and (g) wherein said upper and lower mandrels move relatively as fluid is transferred between said upper and lower fluid chambers along said flow path (h) alignment means cooperatively aligning said lower mandrel within said upper mandrel for reciprocating movement.

* * * * *